US005562442A

United States Patent [19]

Wilhelm

[11] Patent Number: 5,562,442

[45] Date of Patent: Oct. 8, 1996

[54] REGENERATIVE THERMAL OXIDIZER

[75] Inventor: Freidrich Wilhelm, Gartringen, Germany

[73] Assignee: Eisenmann Corporation, Crystal Lake, Ill.

[21] Appl. No.: 364,768

[22] Filed: Dec. 27, 1994

[51] Int. Cl.[6] ..... F23G 7/06

[52] U.S. Cl. ..... 432/72; 432/180; 110/211; 431/5

[58] Field of Search ..... 110/210, 211, 110/212; 432/179, 180, 181, 182, 72 I; 431/5

[56] References Cited

U.S. PATENT DOCUMENTS

| | | | |
|---|---|---|---|
| 1,970,534 | 8/1934 | Colby et al. . | |
| 3,172,251 | 3/1965 | Johnson . | |
| 3,509,834 | 5/1970 | Rosenberg et al. . | |
| 3,664,413 | 5/1972 | Bo . | |
| 3,718,440 | 2/1973 | Foster-Pegg . | |
| 3,895,918 | 7/1975 | Mueller . | |
| 3,914,088 | 10/1975 | Huyck . | |
| 3,997,294 | 12/1976 | Kritzler . | |
| 4,126,419 | 11/1978 | Katabuchi et al. . | |
| 4,280,416 | 7/1981 | Edgerton | 110/254 |
| 4,454,826 | 6/1984 | Benedick . | |
| 4,650,414 | 3/1987 | Grenfell . | |
| 4,678,643 | 7/1987 | Fetzer . | |
| 4,850,862 | 7/1989 | Bjerklie . | |
| 4,867,949 | 9/1989 | Betz . | |
| 5,016,547 | 5/1991 | Thomason | 110/211 |
| 5,024,817 | 6/1991 | Mattison . | |
| 5,163,829 | 11/1992 | Wildenberg . | |
| 5,352,115 | 10/1994 | Klobucar | 432/181 |
| 5,362,449 | 11/1994 | Hedenhag | 432/180 |
| 5,460,789 | 10/1995 | Wilhelm | 422/173 |

FOREIGN PATENT DOCUMENTS

| | | |
|---|---|---|
| 0548630A1 | 12/1992 | European Pat. Off. . |
| 133704 | 1/1979 | Germany . |

OTHER PUBLICATIONS

"Eisenmann Umwelttechnik" UT22 Sales Document and Certified Translation thereof (not dated).

*Primary Examiner*—Thomas E. Denion
*Attorney, Agent, or Firm*—Gerald S. Geren

[57] ABSTRACT

A regenerative thermal oxidizer (RTO) is constructed to receive polluted waste gases from an industrial process, cleanse the gas and permit cleansed gas to exit the RTO to the environment. The RTO includes a lower section having an inlet to receive polluted or incoming gas, and a centrally positioned rotary distributor in the lower section for cooperation in controlling gas flow via a segmented center section. The rotary distributor is substantially smaller than the lower section and is of a substantially smaller cross section. Incoming gas is directed to a middle section segment(s), fills the segment(s) and then flows through a peripheral opening to a segmented upper section where it passes through a heat exchanger to a combustion chamber where it is oxidized or cleansed. From there cleansed gas passes through another upper section segment through a heat exchanger and back to center section segment(s). In the center section the cleansed gas flows to the rotary distributor where it is divided into outgoing and purge gases. The outgoing gas flows through the rotor to a manifold and then to an outlet. The purge gas flows through a purge segment in the rotor to a center discharge pipe. From the pipe the purge gas is directed to a conduit for exiting the RTO and the purge gas is then recycled to the incoming gas to the RTO.

12 Claims, 3 Drawing Sheets

REGENERATIVE THERMAL OXIDIZER

BACKGROUND OF THE INVENTION

This invention relates to an apparatus for efficiently cleaning polluted waste gases from an industrial process, and more particularly to an apparatus known as a regenerative thermal oxidizer (hereinafter an RTO).

It is desirable to clean polluted gases which exit an industrial process so as to emit or release clean gases to the environment.

There are many devices which provide cleaned gases. See for example, U.S. Pat. Nos. 3,172,251; 3,914,088; 3,997,294; 4,280,416; 4,454,826; 4,650,414; 4,678,643; 4,850,862; 4,867,949; 5,016,547; 5,024,817; 5,163,829; and German Patent 133,704. See also European patent document No. 0548630A1, which discloses a regenerative thermal oxidizer.

Incineration systems may employ a combustion chamber to burn or incinerate incoming polluted gases and related delivery and valving mechanisms. There is an inlet to receive incoming polluted gas and a structure or mechanism to direct the incoming gas to a combustion chamber. In some systems the incoming gas passes through heat exchanger material (which has been heated) before it reaches the combustion chamber to raise the incoming gas temperature. In the combustion chamber the gas is burned or cleaned and the cleansed or outgoing gas is directed, sometimes, through heat exchanger material, where it gives up heat and then to an outlet for outgoing cleaned gas. The heat exchanger materials are used to transfer heat from the outgoing gas to the incoming gas.

It has been found to be desirable to segment the combustion chamber construction and sequentially pass incoming gas to selected segments and receive outgoing gas from other, generally oppositely positioned, selected segments. This is sometimes done using a distribution device which may be rotary.

It has also been found to be desirable to purge a segment before cleaned or outgoing gas passes through that segment. The purge gas is usually from external sources. Rotary valving for the sequential delivery of incoming and purge gases and expulsion of outgoing gas is shown. Also see for example U.S. Pat. Nos. 4,280,416 and 5,016,547.

European Patent document 0548630A1 discloses an RTO device where the purge gas is drawn from the cleaned outgoing gas and exits an upper section via a rotating segment that is as large in radius as the RTO housing.

It is believed that the European unit embodies many desirable features and while generally acceptable can be improved in efficiency and for use in the United States of America.

Therefore, it is an object of this invention to provide improvements to a European type system so as to render it more efficient and more acceptable in the U.S.

This and other objects of this invention shall become apparent from the following description and appended claims.

SUMMARY OF THE INVENTION

There is provided by this invention an improved RTO which has an elongated housing and has lower, center and upper sections and a smaller diameter rotating segment, which also known as a rotary distributor, that cooperates with the center section. Incoming polluted gas enters the unit via an inlet in the lower section, flows to and through the center section, to the upper section, through a heat exchanger and to the combustion chamber. The polluted gas is burned and cleansed in the combustion chamber and flows downwardly through heat exchanger material to and through the center section and then to the rotary distributor where it is divided into purge and cleaned gas. The cleansed gas flows through the distributor and exits via an outlet. The purge gas enters a chamber in the distributor, flows to the center of the distributor and exits via a purge gas outlet where it may be recycled into the incoming polluted gas.

The rotary distributor is located at the center of the lower section, cooperates with the center section, and is significantly smaller than the diameter of the lower or center sections. Incoming gas passes between the lower section and the center section adjacent the center thereof. On the other hand gas passes between the center and upper sections outwardly of the center, adjacent the periphery, so that the center section becomes a distributor chamber.

This unit is improved and believed to be more efficient than prior art units and is believed to be more in line with U.S. practices.

DESCRIPTION OF THE PREFERRED EMBODIMENT

Figure 1:
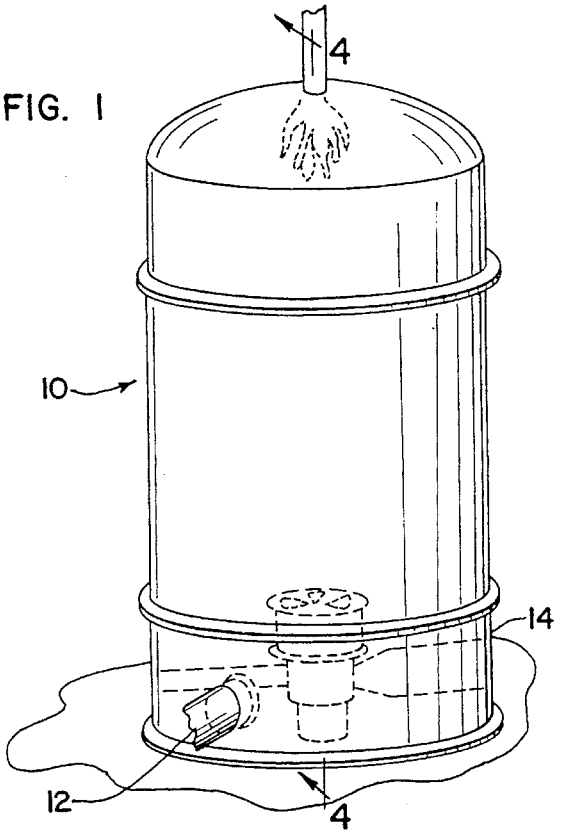
FIG. 1 is a perspective view of the exterior of a Regenerative Thermal Oxidizer (RTO) showing parts of the lower section in phantom or by broken line.
Figure 3:
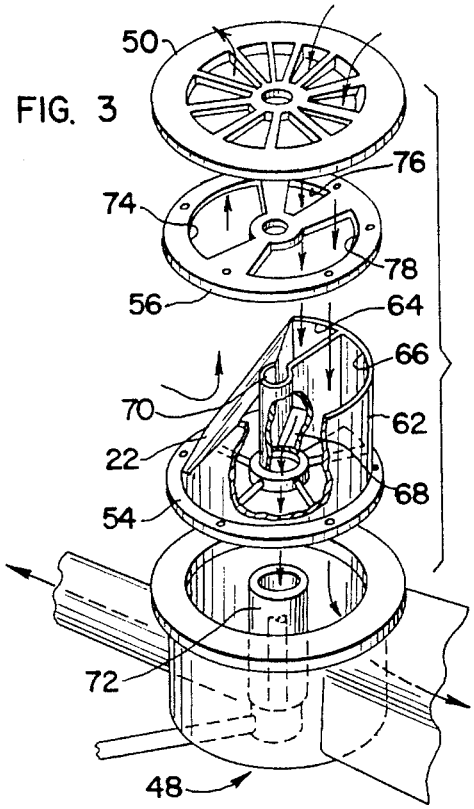
FIG. 3 is an exploded perspective view of the rotary distributor shown in FIG. 2.
Figure 2:
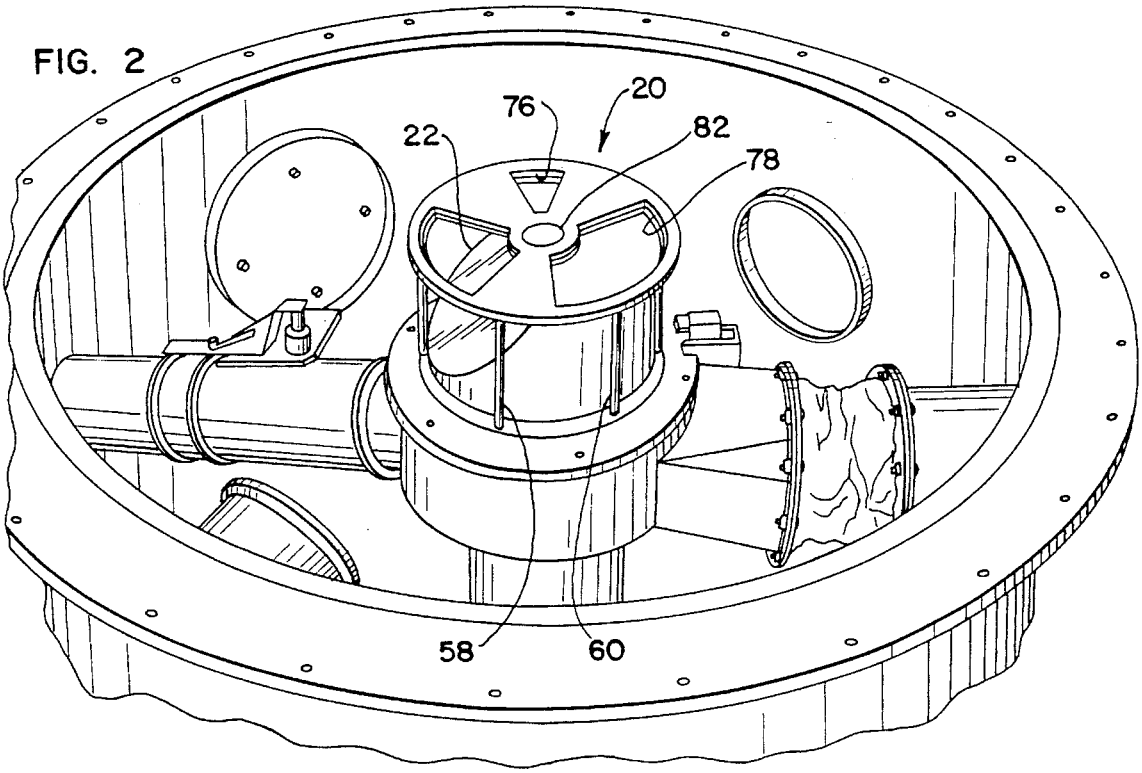
FIG. 2 is a perspective view of the lower section of the RTO with the inlet, outlet and rotary distributor shown.

Referring first to FIG. 1, there is shown a RTO 10 that is generally vertical, cylindrical and elongated and has an inlet 12 for polluted or incoming gas and an outlet 14 for cleansed or outgoing gas. A combustion chamber is provided at the top of the RTO and is suggested by the flame 16.

Figure 4:
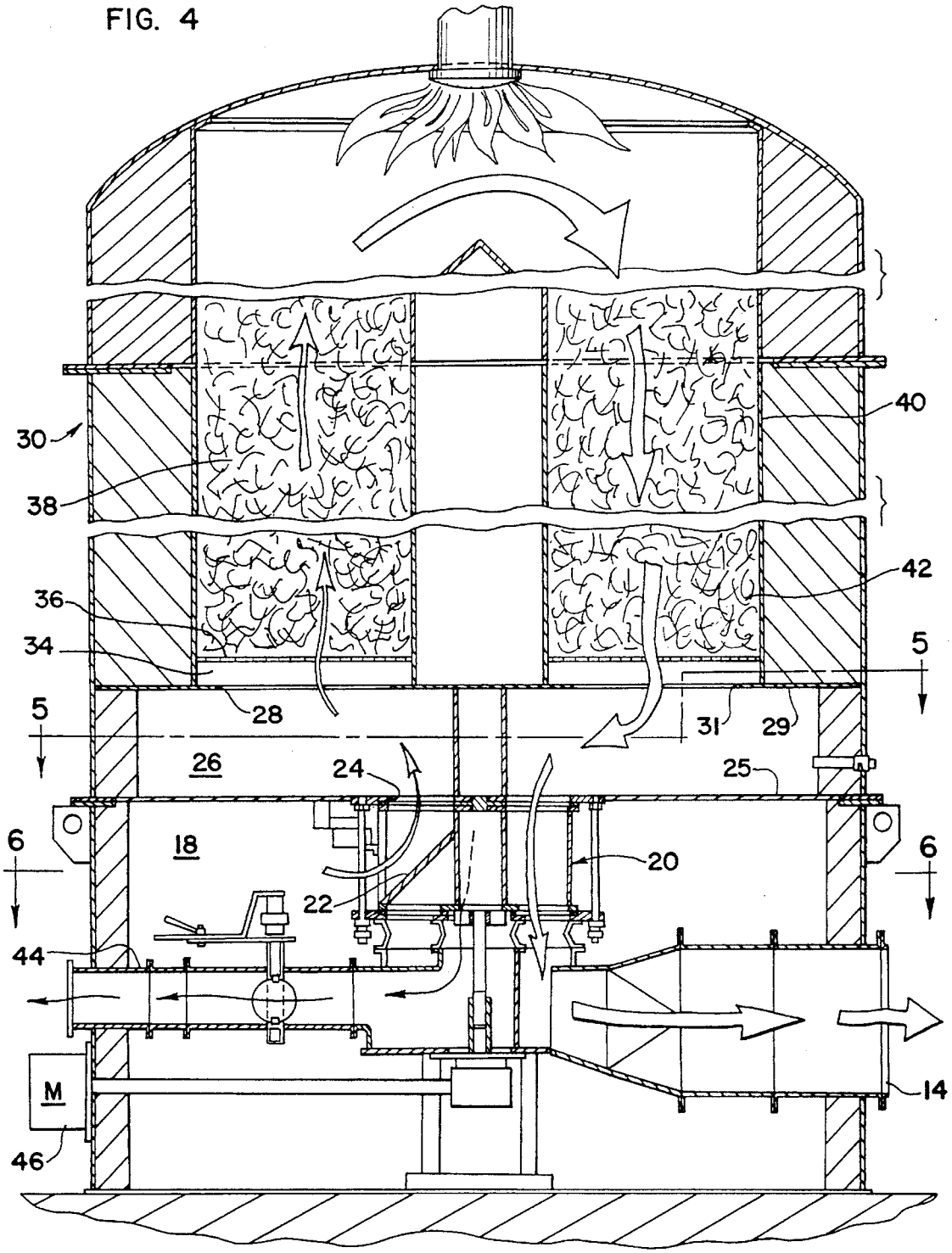
FIG. 4 is a vertical cross-sectional view taken along line 4—4 of FIG. 1 showing the interior of the RTO and depicting the gas flow path.
Figure 5:
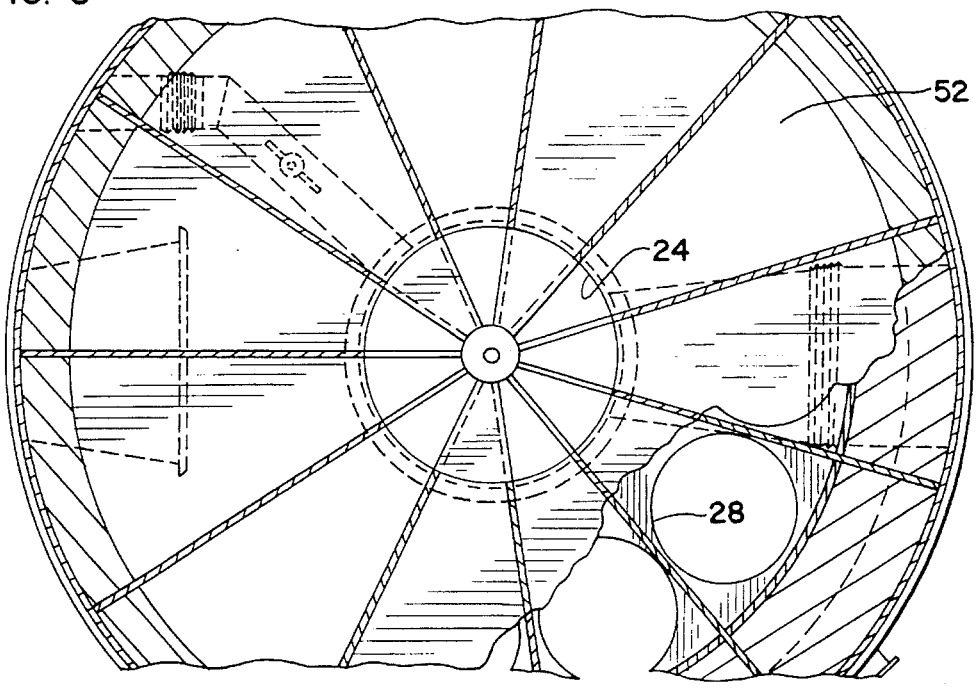
FIG. 5 is a horizontal cross-sectional view taken along line 5—5 of FIG. 4 and showing the center section.
Figure 6:
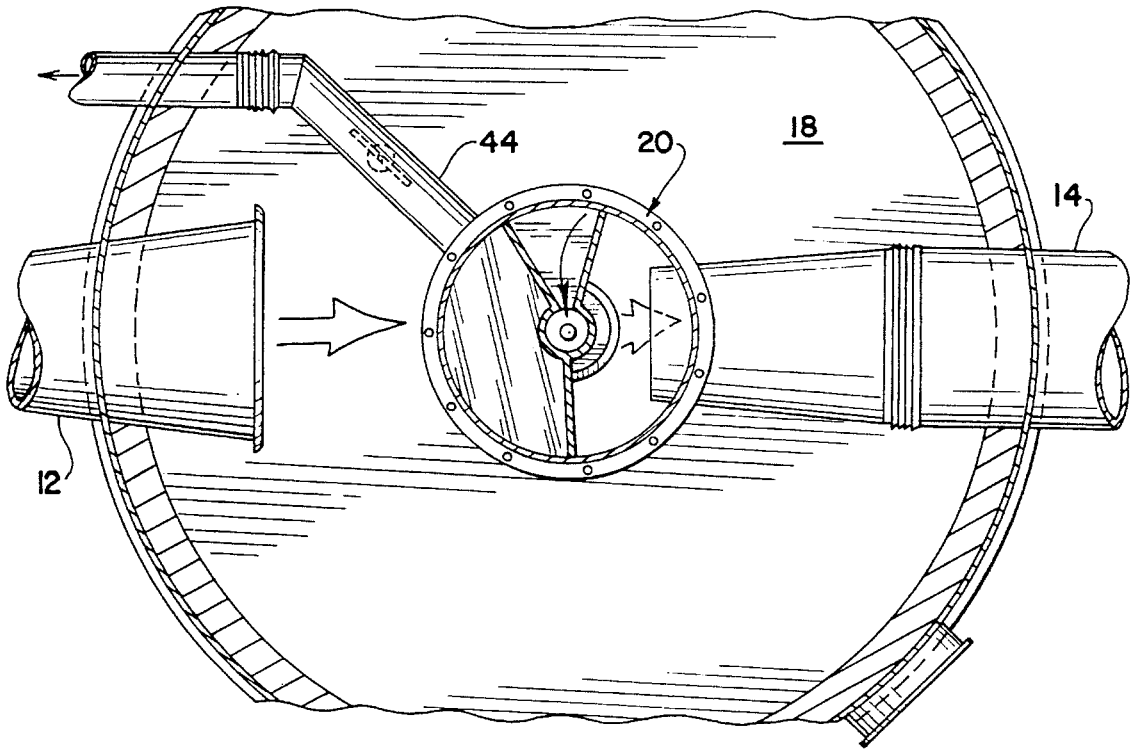
FIG. 6 is a horizontal cross-sectional view, similar to FIG. 5, taken along line 6—6 of FIG. 4 and showing the lower section with the inlet, outlet, purge conduit and distributor.

Referring now to FIG. 4 and 6, incoming gas enters the RTO via inlet 12 and flows into a plenum or space 18 defined by the lower section. The incoming gas fills the plenum and flows to a centrally-positioned rotary distributor 20 generally and is deflected by the angular plate 22 to the center section 26. A wall-like partition or plate 25 separates the lower and center sections and there is provided a central opening 24 in the plate. The center section is somewhat disc-like, cylindrical, stationary and defines eleven (11) pie-shaped segments. Incoming gas enters a segment or segments of the center section at the center and fills the segment. The gas flows toward the periphery to a peripheral opening such as 28 in the upper plate 29. An opening such as 28 is provided for each segment and leads to the upper section 30.

The upper section 30 is also segmented into 11 pie-shaped segments which are aligned with the center section segments and the peripheral opening such as 28. Each segment in the upper section has a small space 34 adjacent the opening such as 28. A perforated metal plate 36 that supports heat exchange material also defines the top of the space. Each upper section segment is filled with heat exchange material, such as ceramic granules 38. The perforated plate 36 acts as a support for the ceramic. The incoming gas flows through the heat exchange material or granules 38 to the combustion chamber 16 where the pollutants are oxidized. The heat exchange material has been previously heated and thus the incoming gas picks up heat.

The incoming polluted and heated gas is then burned, oxidized and forms outgoing or cleansed gas which passes through the other segment 40 and the heat exchange material 42. The segment(s) for the incoming gas may be diametrically opposite the segment(s) for the outgoing gas. The cleansed gas exits the upper section via an opening such as 28 and enters the center section via peripheral opening 31. As it exits the upper section, the outgoing gas loses heat to the heat exchange material.

As will be recalled, the center section is segmented, the outgoing gas fills the segment, passes to the center and then down through the center opening 24 and to the rotary distributor 20. From the distributor, the cleansed gas passes to the exit 14.

A small portion of the cleansed gas is separated from the outgoing gas and becomes purge gas. The purge gas is directed to the center of the rotary distributor and then outwardly through the purge gas conduit 44.

The Rotary Distributor

In considering the rotary distributor 20, reference is made to FIGS. 2, 3, 4 and 6. The rotary distributor 20 is a cylindrical member which is adapted to rotate about a central axis. Its outside diameter is significantly less than the housing diameter or the distance from the center to the periphery of the housing. Rotation in this embodiment is in a counter-clockwise direction. A motor drive and transmission shaft arrangement 46 generally located on the outside of the housing drives or rotates the distributor.

The rotor is positioned between a stationary manifold 48 in the lower section and a stationary segmented grate-like member 50 that is mounted at the center of plate 25 that forms the lower section/middle section interface.

The rotor itself is made up of a cylindrically shaped body 54 and a circular or disc-like distribution plate 56 that is secured to the top of the body by elongated screw-like members such as 58 and 60. The rotary distributor transmits, provides communication and distributes gas between the lower section and segments of the center section. The body 54 includes a formed and partially cylindrical housing part 50 that defines the angle or deflection plate 22, a purge gas receiving segment 64 and a large arc-shaped outgoing gas section 66. It is noted that the outgoing gas section is open at the top to receive outgoing gas and is open at the bottom to permit the outgoing gas to flow through the rotor into the manifold 48. The purge gas section is pie-shaped, has a bottom plate 68 which closes the bottom and an open center pipe 70 that communicates with the segment 64 and a conduit 72 in the manifold 48.

From FIG. 4 it is seen that the outgoing gas fills the body interior, and passes through the body to the manifold 48 and from there to the exit 14. From FIGS. 2 and 6, it is seen that the purge gas flows into the segment 64, fills the segment, flows to the center pipe 70 and through the center pipe to the purge conduit 44. Incoming gas enters the inlet 12, fills the lower section 18, surrounds the rotary distributor 20 and is deflected by plate 22 through the grate 50 to the center section.

The distributor plate 56 includes an elongated arc-shaped incoming gas aperture 74, a small pie-shaped purge gas segment aperture 76, and a large arc-shaped outgoing gas aperture 78. It is to be noted that the incoming aperture 74 is generally opposite the outgoing gas aperture 78. Moreover, the incoming aperture is smaller than the outgoing aperture 78. The purge aperture 76 is positioned between the incoming gas aperture 74 and outgoing gas aperture 78 and is smaller than the other apertures.

The distributor plate is mounted to the rotor body 54 in a particular orientation. The incoming gas aperture 74 is aligned with the deflection plate 22 so gas does not flow through the rotary distributor but is deflected off plate 22. The purge aperture 76 is aligned with the purge segment 64. The outgoing gas aperture 78 is aligned with the remainder of the rotor and not the purge aperture 64 or deflection plate 22.

The grate 50 fits in the plate 25 at the center 26, and the plate divides the lower section and middle section. The grate defines the openings through which incoming gas enters the center section and outgoing gas and purge gas exits the center section. The grate is segmented and the grate segments are aligned with the section segments.

Operation

In operation, incoming gas fills the lower section 18 and is deflected by plate 22 through the grate to the center section. The incoming gas fills center section segments and flows to the upper section and the combustion chamber. At the combustion chamber the polluted gas is cleansed to form outgoing gas and from the combustion chamber, outgoing or cleansed gas flows through the upper section segments, to the center section segments and to the center grate 50. Outgoing gas flows through the grate 50, a small portion of the gas flows to the purge aperture 76 and the rest to the outgoing gas aperture 78. The outgoing gas fills the body 54, flows through the body bottom, to the manifold 48 and then flows to the exit 14 via conduit 80.

Some cleansed gas enters the purge aperture 76, flows into the purge segment 64 and to the center pipe 70. At the pipe, the gas flows downwardly to the conduit 72 and out through the purge conduit 44. It will be noted that the purge gas cannot flow upwardly in the center pipe as the top of the pipe is closed off by a plug-like construction 82.

As the distributor is rotated, the incoming, purge and outgoing gas flow to and from different center section segments.

The incoming gas is heated by the heat exchange granules which have been heated by the outgoing gas when it passed downwardly through an upper section segment which is now used for incoming gas. Thus, the outgoing gas looses heat to the heat exchange granules as it passes from the combustion chamber to the center section and incoming gas picks up heat.

In this embodiment, the distributor is rotating counter clockwise and thus the purge aperture 76 leads the outgoing gas aperture 78 so that the purge segment captures the beginning portion of the outgoing gas and thus minimizes the contaminant content of the outgoing gas that exits the system. The purge gas is normally directed back to the incoming gas and is in a sense recycled through the system.

Numerous changes and modifications can be made to the embodiment disclosed herein without departing from the spirit and scope of the invention.

What is claimed is:

1. A regenerative thermal oxidizer for receiving pollutant-containing incoming gas, treating said incoming gas and discharging treated gas, said oxidizer including;

an elongated housing defining a lower section, a center section and an upper section;

the lower section defining an incoming gas inlet, an outgoing gas outlet, a purge gas outlet and a plenum for receiving incoming gas from said incoming gas inlet;

the center section being adjacent the lower section and the upper section (a) for receiving incoming gas from the lower section and directing said gas to the upper section and (b) for receiving treated gas from the upper section and directing treated gas to the lower section;

the upper section for receiving incoming gas from the center section, treating the incoming gas, and directing treated gas to the center section; and a rotary distributor positioned in the lower section and within the plenum and constructed to receive incoming gas from the incoming gas inlet and distribute incoming gas to the center section and to receive treated gas from the center section and transmit treated gas to the outgoing gas outlet and to the purge gas outlet, said rotary distributor having a substantially vertical axis of rotation and defining:

an incoming gas distribution surface which is angularly positioned relative the axis of rotation for directing incoming gas in said plenum to the center section, an outgoing gas chamber within the distributor for receiving treated gas from the center section and directing treated gas to the outgoing gas outlet, and a purge gas chamber within the distributor for receiving treated gas from the center section and directing treated gas to the purge gas outlet.

2. A regenerative thermal oxidizer as in claim 1 which further includes:

said center section defining a plurality of segments, each extending outwardly from the rotary distributor;

said upper section defining a plurality of segments, each substantially aligned with a segment in the center section;

a first partition or wall-like surface that separates the center section and lower section and which defines a centrally positioned opening which is substantially smaller in cross-section than the cross-section of the housing and aligned with the rotary distributor;

a second partition or wall-like surface that separates the center section and the upper section and which defines a plurality of openings, each opening associated with a segment and each opening positioned outwardly from the central opening; and whereby gas is caused to flow laterally in the center section between the center opening and the openings associated with the segments.

3. A regenerative thermal oxidizer as in claim 2 wherein each opening defined by the wall separating the center and upper section provides communication between a center section segment and an upper section.

4. A regenerative thermal oxidizer as in claim 1 wherein the rotary distributor includes a cylindrically-shaped body and an apertured distribution plate mounted on the body which together control gas flow between the lower and the center sections.

5. A regenerative thermal oxidizer as in claim 4 wherein said body defines said incoming gas distribution surface and said distribution plate defines an incoming gas aperture aligned with the incoming gas distribution surface through with incoming polluted gas passes as it moves to the center section from the lower section.

6. A regenerative thermal oxidizer as in claim 4 wherein said body defines said outgoing gas chamber which includes an open top and an open bottom for directing outgoing treated gas from the center section to the outgoing gas outlet and said distribution plate includes an outgoing gas aperture aligned with the outgoing gas chamber through which treated gas from the center section flows to the lower section and the outlet.

7. A regenerative thermal oxidizer as in claim 4 wherein said body defines said purge gas chamber, said purge gas chamber having an open top, a closed bottom and a center conduit aligned with a vertical axis of rotation whereby gas from the center section flows through the purge chamber to the center conduit and to the purge gas outlet, and said distribution plate includes a purge gas aperture aligned with the purge gas chamber through which treated gas passes from the center section to the lower section.

8. A regenerative thermal oxidizer as in claim 6 wherein there is provided a conduit associated with the rotary distributor for communicating treated gas from the outgoing gas chamber bottom to the outgoing gas outlet and said conduit extends through said lower section.

9. A regenerative thermal oxidizer as in claim 2 wherein there is provided heat exchanger material positioned in each segment of the upper section.

10. A regenerative thermal oxidizer for receiving pollutant-containing incoming gas, treating said incoming gas and discharging treated gas, said oxidizer including:

an elongated housing defining a lower section, a center section and an upper section;

the lower section defining an incoming gas inlet, an outgoing gas outlet, a purge gas outlet and a plenum for receiving incoming gas from said incoming gas inlet;

the center section being adjacent the lower section and the upper section (a) for receiving incoming gas from the lower section and directing said gas to the upper section and (b) for receiving treated gas from the upper section and directing treated gas to the lower section;

the upper section for receiving incoming gas from the center section, treating the incoming gas, and directing treated gas to the center section;

a rotary distributor positioned in the lower section and within the plenum and constructed to receive incoming gas from the incoming gas inlet and distribute incoming gas to the center section and to receive treated gas from the center section and transmit treated gas to the outgoing gas outlet and to the purge gas outlet, said rotary distributor having a substantially vertical axis of rotation and defining;

an incoming gas distribution surface which is angularly positioned relative the axis of rotation for directing incoming gas in said plenum to the center section;

an outgoing gas chamber within the distributor for receiving treated gas from the center section and directing treated gas to the outgoing gas outlet, and a purge gas chamber within the distributor for receiving treated gas from the center section and directing treated gas to the purge gas outlet;

said center section defining a plurality of segments, each extending outwardly from the rotary distributor;

said upper section defining a plurality of segments, each substantially aligned with a segment in the center section;

a first partition or wall-like surface that separates the center section and lower section and which defines a centrally positioned opening which is substantially smaller and cross-section than the cross-section of the housing and aligned with the rotary distributor;

a second partition or wall-like surface that separates the center section and the upper section and which defines a plurality of openings, each opening associated with a segment and each opening positioned outwardly from the central opening;

whereby gas is caused to flow laterally in the center section between the center opening and the openings associated with the segments;

wherein each opening defined by the wall separating the center and upper section provides communication between a center section segment and an upper section;

wherein the rotary distributor includes a cylindrically-shaped body and an apertured distribution plate mounted on the body which together control gas flow between the lower and the center sections;

wherein said body defines said incoming gas distribution surface and said distribution plate defines incoming gas aperture aligned with the incoming gas distribution surface through with incoming polluted gas passes as it moves to the center section from the lower section;

wherein said body defines said outgoing gas chamber which includes an open top and an open bottom for directing outgoing treated gas from the center section to the outgoing gas outlet and said distribution plate includes an outgoing gas aperture aligned with the outgoing gas chamber through which treated gas from the center section flows to the lower section and the outlet;

wherein said body defines said purge gas chamber, said purge gas chamber having an open top, a closed bottom and a center conduit aligned with a vertical axis of rotation whereby gas from the center section flows through the purge chamber to the center conduit and to the purge gas outlet, and said distribution plate includes a purge gas aperture aligned with the purge gas chamber through which treated gas passes from the center section to the lower section;

wherein there is provided a conduit associated with the rotary distributor for communicating treated gas from the outgoing gas chamber bottom to the outgoing gas outlet and said conduit extends through said lower section; and wherein there is provided heat exchanger material positioned in each segment of the upper section.

11. A method for treating polluted industrial gases comprising the steps of:

(a) providing a regenerative thermal oxidizer having an elongated housing which defines a lower section, a center section and an upper section; with the lower section defining an incoming gas inlet, an outgoing gas outlet, a purge gas outlet and a plenum for receiving incoming gas from said incoming gas inlet; the center section being adjacent the lower section and the upper section; the upper section constructed to receive and treat incoming gas from the center section and direct treated gas to the center section; a rotary distributor positioned in the lower section to transmit incoming gas and receive treated gas, an incoming gas distribution surface which is angularly positioned relative to the axis of rotation of the rotary distributor; an outgoing gas chamber within the distributor for receiving treated gas from the center section and a purge gas chamber and a purge gas chamber within the distributor for receiving treated gas from the chamber;

(b) causing incoming polluted gas to flow into the lower section;

(c) causing the incoming gas from the lower section flow into the center section through the center;

(d) causing the polluted gas to flow upwardly from the center section into said upper section segments;

(e) causing the polluted gas to flow through the upper section and be treated;

(f) causing the treated gas to flow from the upper section to the center section;

(g) causing treated gas in the center section to flow to the lower section;

(h) separating the treated gas via the rotary distributor into purge gas and outgoing gas, flowing outgoing gas through the lower section to an outlet, and flowing purge gas through the lower section to a purge gas outlet.

12. A regenerative thermal oxidizer for receiving pollutant-containing incoming gas, treating said gas and discharging treated gas, said oxidizer including:

an elongated housing defining a first section and a second section;

the first section defining an incoming gas inlet, an outgoing gas outlet, a purge gas outlet and a plenum for receiving incoming gas from said incoming gas inlet;

the second section for receiving incoming gas from the first section and directing treated gas to the first section;

a rotary distributor positioned in the first section and within the plenum, and constructed to receive incoming gas from the plenum and direct said incoming gas to the first second section and receive treated gas from the second section and direct treated gas to the outgoing gas outlet and to the purge gas outlet, said rotary distributor constructed to rotate about a substantially vertical axis and having:

an incoming gas distribution surface which is angularly disposed relative to the axis of rotation for directing gas in said plenum to be transmitted to the second section, an outgoing gas chamber within the distributor for receiving treated gas and directing treated gas to the outgoing gas outlet, and a purge gas chamber within the distributor for receiving treated gas and directing treated gas to the purge gas outlet.

* * * * *

UNITED STATES PATENT AND TRADEMARK OFFICE

CERTIFICATE OF CORRECTION

PATENT NO. : 5,562,442
DATED : October 8, 1996
INVENTOR(S) : Friedrich Wilhelm

It is certified that error appears in the above-indentified patent and that said Letters Patent is hereby corrected as shown below:

Column 5, line 33, insert --to-- after "relative".

Column 6, line 60, insert --to-- after "relative".

Column 8, line 47 delete "first" prior to ''second section".

Signed and Sealed this

Twenty-sixth Day of May, 1998

Bruce Lehman

*Attest:*

BRUCE LEHMAN

*Attesting Officer*

*Commissioner of Patents and Trademarks*